US008939797B2

(12) United States Patent
Ciampolini et al.

(10) Patent No.: US 8,939,797 B2
(45) Date of Patent: Jan. 27, 2015

(54) CONNECTION SYSTEM FOR ESTABLISHING ELECTRICAL CONNECTION BETWEEN ELECTRICAL DEVICE FOR AUTOMOTIVE INDUSTRY AND AT LEAST ONE PAIR OF CABLES

(75) Inventors: Franco Ciampolini, Bologna (IT); Riccardo Viancino, Turin (IT); Mauro Quacquarelli, Beinasco (IT); Fulvio Cicognati, Chieri (IT)

(73) Assignee: Magneti Marelli S.p.A., Corbetta (IT)

( * ) Notice: Subject to any disclaimer, the term of this patent is extended or adjusted under 35 U.S.C. 154(b) by 205 days.

(21) Appl. No.: 13/561,171

(22) Filed: Jul. 30, 2012

(65) Prior Publication Data

US 2013/0122751 A1 May 16, 2013

(30) Foreign Application Priority Data

Jul. 29, 2011 (IT) ..... BO2011A0466

(51) Int. Cl.

| | |
|---|---|
| ***H01R 9/03*** | (2006.01) |
| ***H01R 4/34*** | (2006.01) |
| ***H01R 11/12*** | (2006.01) |
| *H01R 105/00* | (2006.01) |
| *H01R 27/00* | (2006.01) |
| *H01R 33/92* | (2006.01) |

(Continued)

(52) U.S. Cl.

CPC ..... *H01R 4/34* (2013.01); *H01R 11/12* (2013.01); *H01R 2105/00* (2013.01); *H01R 27/00* (2013.01); *H01R 33/92* (2013.01); *H01R 13/5804* (2013.01); *H01R 13/6271* (2013.01)

USPC ..... 439/657; 439/860

(58) Field of Classification Search

USPC ..... 439/638, 639, 860, 657

See application file for complete search history.

(56) References Cited

U.S. PATENT DOCUMENTS

| | | | | |
|---|---|---|---|---|
| 3,090,936 | A * | 5/1963 | Maitby | 439/595 |
| 4,056,299 | A * | 11/1977 | Paige | 439/439 |
| 4,698,459 | A * | 10/1987 | Drake | 174/138 F |

(Continued)

FOREIGN PATENT DOCUMENTS

| | | |
|---|---|---|
| CN | 201549613 U | 8/2010 |
| EP | 2144332 A1 | 1/2010 |

OTHER PUBLICATIONS

Aug. 24, 2012 Search Report for Italian Patent App. No. IT B020110466.

(Continued)

*Primary Examiner* — Neil Abrams
*Assistant Examiner* — Travis Chambers
(74) *Attorney, Agent, or Firm* — Howard & Howard Attorneys PLLC

(57) ABSTRACT

A connection system establishes an electrical connection between an electrical device and at least one pair of cables each of which ends with a cable terminal. The connection system comprises a fixed part including a support base adapted to be rigidly fitted to a wall of the electrical device and, for each cable, a connection screw protruding from the support base and electrically connectable to the electrical device. A mobile part includes a perimeter frame adapted to be mechanically fitted to the support base and having a passage wall defining, for each cable, a passage-through hole through which an end part of the cable passes so that the corresponding cable terminal is disposed inside the perimeter frame and aligned with the respective connection screw when the perimeter frame is mechanically fitted to the support base.

10 Claims, 12 Drawing Sheets

(51) Int. Cl.
*H01R 13/58* (2006.01)
*H01R 13/627* (2006.01)

(56) References Cited

U.S. PATENT DOCUMENTS 5,021,305 A * 6/1991 Turner ..... 429/65
5,173,060 A * 12/1992 Shimirak et al. ..... 439/416
5,295,860 A * 3/1994 Jozefczyk et al. ..... 439/503
6,533,619 B2 * 3/2003 Wakata et al. ..... 439/680
6,664,678 B2 * 12/2003 Shimizu ..... 310/71
6,802,748 B2 * 10/2004 Wertz et al. ..... 439/830
6,806,421 B2 * 10/2004 Matsumura ..... 174/50
6,814,617 B2 * 11/2004 Oota et al. ..... 439/589
8,056,867 B2 * 11/2011 Tan Chin Yaw et al. ..... 248/51
8,466,586 B2 * 6/2013 Tarchinski et al. ..... 307/328
8,790,135 B2 * 7/2014 Maegawa ..... 439/587
2002/0043883 A1 4/2002 Shimizu
2009/0137153 A1 * 5/2009 Yoshioka et al. ..... 439/607.24
2010/0084205 A1 4/2010 Tarchinski et al.
2012/0196490 A1 * 8/2012 De Blieck et al. ..... 439/681

OTHER PUBLICATIONS

Database WPI Week 201062 Thomson Scientific London, GB AN 2010-L29345 XP-002682292.

* cited by examiner

CONNECTION SYSTEM FOR ESTABLISHING ELECTRICAL CONNECTION BETWEEN ELECTRICAL DEVICE FOR AUTOMOTIVE INDUSTRY AND AT LEAST ONE PAIR OF CABLES

REFERENCE TO RELATED APPLICATION

This application claims benefit of the filing date of and priority to Italian Patent Application BO2011A 000466 filed on Jul. 29, 2011.

BACKGROUND OF INVENTION

1. Field of Invention

The invention relates to, in general, a connection system and, in particular, one for establishing an electrical connection between an electrical device for the automotive industry and at least one pair of cables. The invention is advantageously applied to an, electrical-traction vehicle and, in particular, a hybrid vehicle for establishing an electrical connection between an electronic-control unit and a rotating electrical machine by a tern of cables.

2. Description of Related Art

Electrical traction combined with traditional thermal traction for making hybrid traction is becoming increasingly more popular in road vehicles. Electrical traction generally includes the use of a three-phase (typically synchronous of the "permanent magnet" type) reversible-rotating electrical machine (i.e., that may work as either an electrical motor drawing electricity and generating a mechanical motive torque or electrical generator drawing mechanical energy and generating electricity) one side of which is mechanically connected or connectable to the drive wheels and the other side of which is electrically connected to an electronic-control unit (containing an electronic-power converter). The connection between the rotating electrical machine and electronic-control unit occurs by three cables that are nominally flexible, but that, in fact, have a rather limited flexibility due to their large cross-sectional area (in the order of about 50-70 $mm^2$ each) and external electromagnetic-interference shielding.

On one end, each cable is fixed to a corresponding terminal of the rotating electrical machine, and, on the other end, each cable is fixed to a corresponding terminal of the electronic-control unit. Generally, each cable is connected to the terminal of the rotating electrical machine at the time of construction of the rotating electrical machine (with the rotating electrical machine off the vehicle and wide possibilities of working about the rotating electrical machine itself). Thus, the connection between each cable and the terminal of the rotating electrical machine is simple and quick to establish even if the flexibility of the cables is relatively limited. Instead, each cable is connected to the terminal of the electronic-control unit aboard the vehicle when both the electronic-control unit and rotating electrical machine are already installed in their respective final positions (when the electronic-control unit is not very accessible and with little freedom of movement. Consequently, the connection between each cable and the terminal of the electronic-control unit is complex and hardworking.

Currently, each cable ends with an eyelet terminal that must be inserted, one at a time, about a connection screw of a corresponding terminal of the electronic-control unit, the eyelet connection being fixed to the connection screw by a nut coupled to one washer or more washers. Such a connection method is cost-effective and reliable (i.e., does not separate over time, by effect of vibrations), but, on the contrary, also rather complex and hardworking to implement due to (as explained above) the reduced accessibility to the electronic-control unit.

To make the "connection" operation simpler, it has been suggested to apply male connectors to the cables and corresponding female connectors to the electronic-control unit. In this manner, the male connectors of the cables are simply inserted in the corresponding female connectors of the electronic-control unit to establish the connection. However, this solution is much more costly (due to the high cost of the connectors) and less reliable because the prolonged vibrations of the vehicle may determine a separation (also only partial) between a male connector and the corresponding female connector.

Thus, there is a need in the related art for a connection system for establishing an electrical connection between an electrical device for the automotive industry and at least one pair of cables. More specifically, there is a need in the related art for such a connection system that is free from the drawbacks described above and, at the same time, simple and cost-effective to establish.

SUMMARY OF INVENTION

The invention overcomes the disadvantages in the related art in a connection system for establishing an electrical connection between an electrical device and at least one pair of cables. The connection system comprises a fixed part including a support base that is adapted to be rigidly fitted to a wall of the electrical device and, for each of the cables, a connection screw that protrudes from the support base and can be electrically connected to the electrical device. A mobile part includes a perimeter frame that is adapted to be mechanically fitted to the support base and has a passage wall that defines, for each of the cables, a passage-through hole of the passage wall through which an end part of the cable passes so that the corresponding cable terminal is disposed inside the perimeter frame and aligned with the respective connection screw when the perimeter frame is mechanically fitted to the support base.

An advantage of the connection system of the invention is that it establishes an electrical connection between an electrical device for the automotive industry and at least one pair of cables.

Another advantage of the connection system of the invention is that it is free from the drawbacks described above and, at the same time, simple and cost-effective to establish.

Another advantage of the connection system of the invention is that it consists of a few elements of non-complex shape.

Another advantage of the connection system of the invention is that it allows rapid and simple establishment/separation of an electrical connection between an electrical device for the automotive industry and at least one pair of cables.

Another advantage of the connection system of the invention is that it is not necessary to singularly or manually insert eyelet terminals of the cables in connection screws because the eyelet terminals are "automatically" inserted all together in the connection screws when a perimeter frame of a mobile part is fitted into a support base on a fixed part.

Another advantage of the connection system of the invention is that the electrical connection established by the connection system is extremely reliable over time because the electrical connection cannot be accidentally interrupted in any manner (e.g., by prolonged vehicle vibrations).

Another advantage of the connection system of the invention is that it allows establishment of an electrical connection between any electrical device for the automotive industry (e.g., electronic-control unit, storage system, mechanical machine, etc.) and at least one pair of cables.

Other objects, features, and advantages of the connection system of the invention are readily appreciated as the connection system becomes more understood while the subsequent detailed description of at least one embodiment of the connection system is read taken in conjunction with the accompanying drawing thereof.

BRIEF DESCRIPTION OF EACH FIGURE OF DRAWING

DETAILED DESCRIPTION OF EMBODIMENT(S) OF INVENTION

Figure 1:
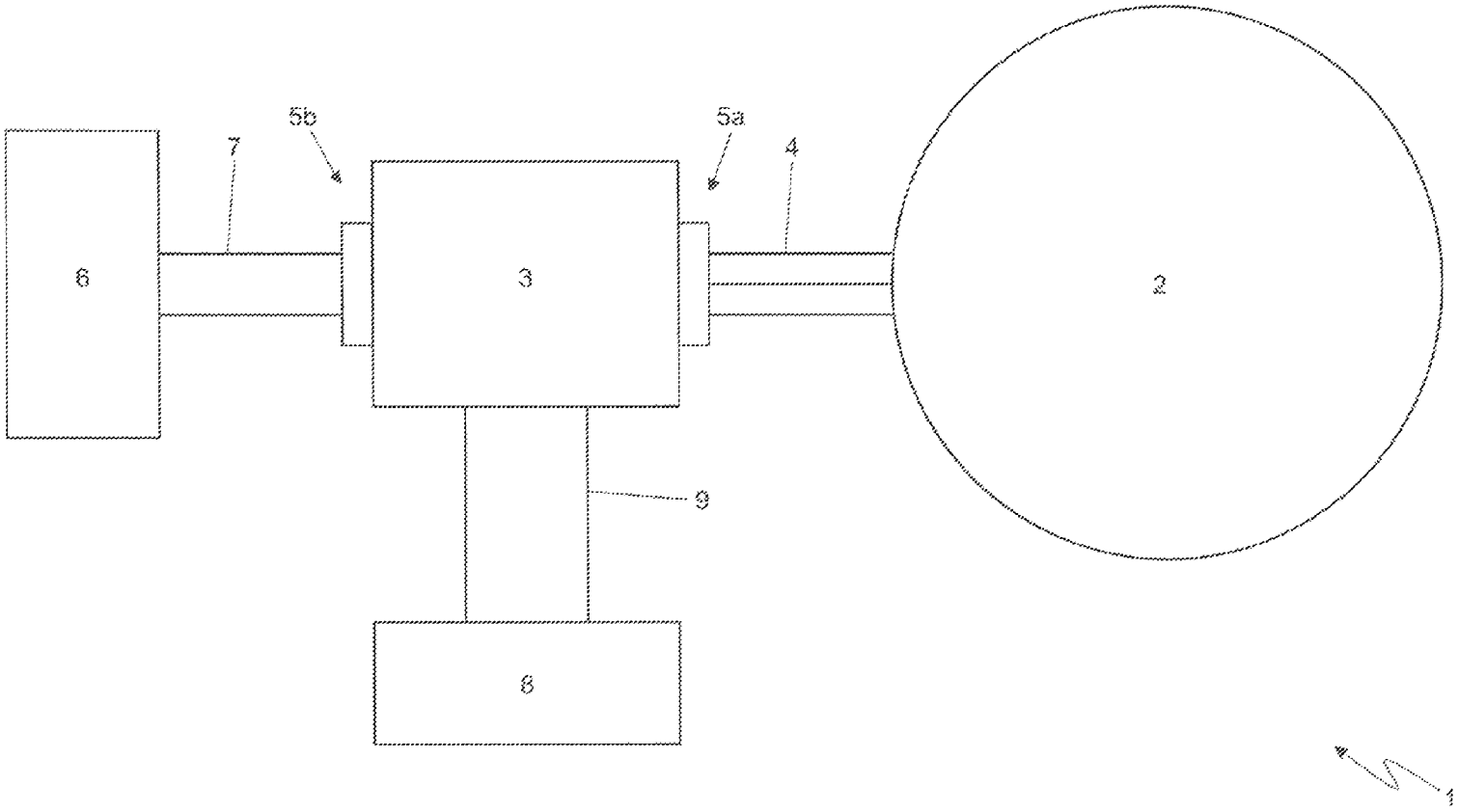
FIG. 1 is a diagrammatical view of an electrical-power system of a hybrid thermal-and-electrical-traction vehicle.

In FIG. 1, an electrical-power system of a hybrid thermal-and-electrical-traction vehicle is generally indicated at 1. The electrical-power system 1 includes a three-phase (typically synchronous of the "permanent magnet" type) reversible electrical machine 2 (i.e., that may work as either an electrical motor drawing electricity and generating mechanical motive torque or electrical generator drawing mechanical energy and generating electricity) that is typically connected or connectable to the drive wheels of the vehicle. The electrical-power system 1 includes further an electronic-control unit 3 (containing an electronic-power converter) that is electrically connected to the electrical machine 2 by three cables 4.

Each cable 4 is fixed in non-separable manner (or, rather, non-easily-separable manner) to the electrical machine 2 (the cables 4 are separated from the electrical machine 2 only in case of supplementary repairs carried out on the electrical machine 2) and separable manner (i.e., easily separable manner) to the electronic-control unit 3. In particular, a connection system 5*a* is provided by which the three cables 4 can be simply and rapidly coupled/uncoupled to/from the electronic-control unit 3.

The electrical-power system 1 further comprises a high-voltage storage system 6 (typically, 600 volts) that is suited to store electricity and electrically connected to the electronic-control unit 3 by a pair of cables 7. Each cable 7 is fixed in non-separable manner (or, rather, non-easily-separable manner) to the storage system 6 and separable manner (i.e., easily separable manner) to the electronic-control unit 3. In particular, a connection system 5*a* is provided by which the two cables 7 can be simply and rapidly coupled/uncoupled to/from the electronic-control unit 3.

Figure 2:
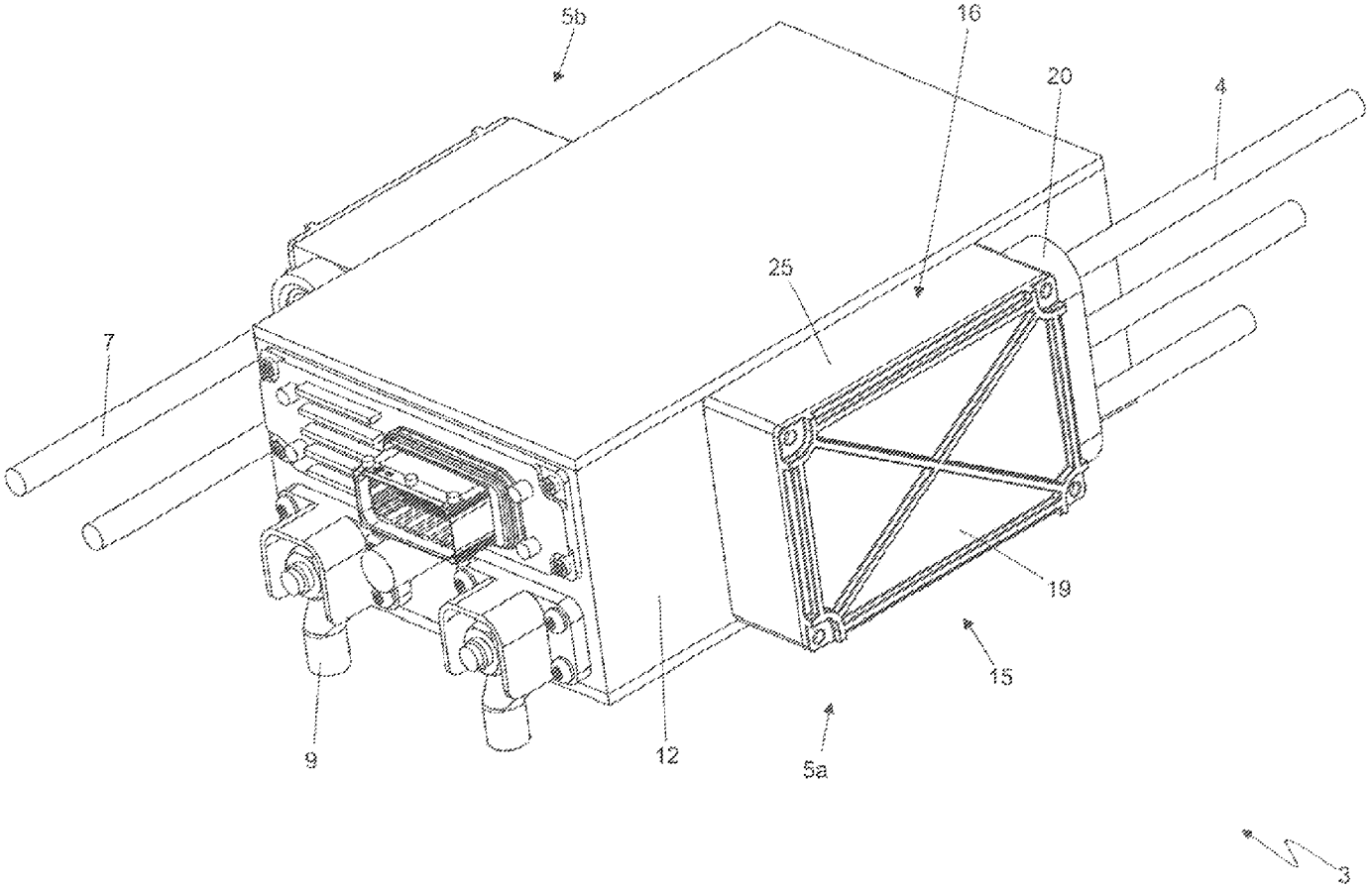
FIG. 2 is a perspective diagrammatical view of an electronic-control unit of the electrical-power system illustrated in FIG. 1.
Figure 3:
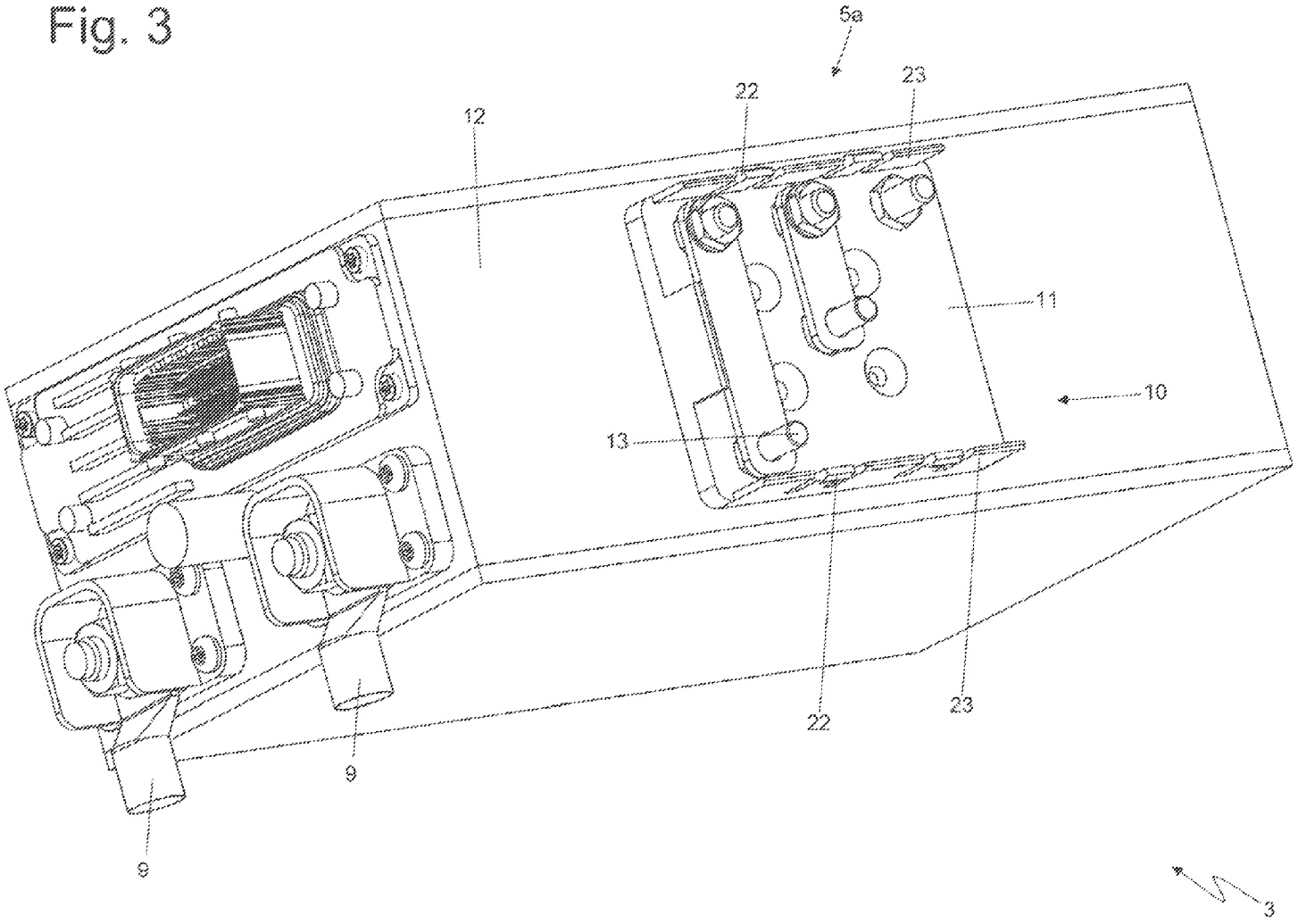
FIG. 3 is a perspective diagrammatical view of the electronic-control unit illustrated in FIG. 2 free from a mobile part of the first three-pole connection system in accordance with the invention.
Figure 4:
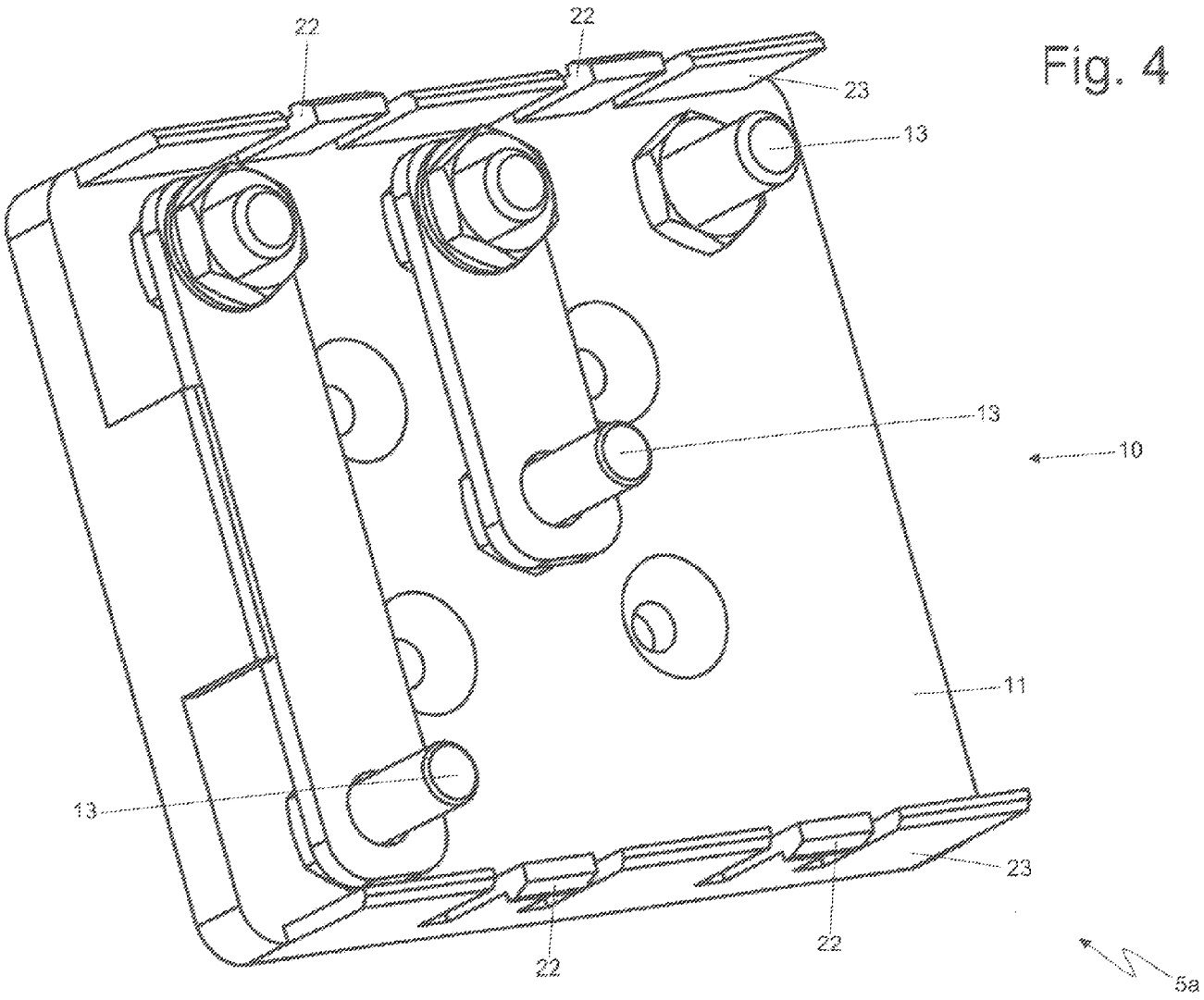
FIG. 4 is a view on an enlarged scale of a detail illustrated in FIG. 3 that shows a fixed part of the first connection system.

Finally, the electrical-power system 1 comprises a low-voltage storage system 8 (typically, 12 volts) that is electrically connected to the electronic-control unit 3 by a pair of cables 9 that are fixed in conventional manner to the electronic-control unit 3. As shown, for example, in FIG. 2, each cable 9 ends with an eyelet terminal that is fitted about a connection screw that protrudes from the electronic-control unit 3 and maintained in position by a nut screwed onto the connection screw.

The high-voltage storage system 6 comprises a pack of lithium batteries and has the function of storing/releasing large amounts of energy that are exchanged by effect of the electrical traction. The low-voltage storage system 8 normally comprises a single lead battery and has the function of supplying the auxiliary services of the vehicle that operate at low voltage.

As shown in FIGS. 2-9, the connection system 5*a* (that establishes an electrical connection between the electronic-control unit 3 and three cables 4) comprises a fixed part 10 provided with a support base 11 and is suited to be rigidly fixed (typically, screwed) to a side wall 12 of the electronic-control unit 3. Three connection screws 13, each of which is electrically connected to the electronic-control unit 3 and receives a corresponding cable 4, overhangingly protrude (i.e., perpendicularly to the support base 11) from the support base 11 of the fixed part 10. According to an embodiment, each cable 4 ends with a terminal having the shape of an eyelet that is fitted about the respective connection screw 13 of the support base 11 and maintained in position by a nut 14 (shown in FIG. 11) that is screwed into the connection screw 13 itself.

Figure 6:
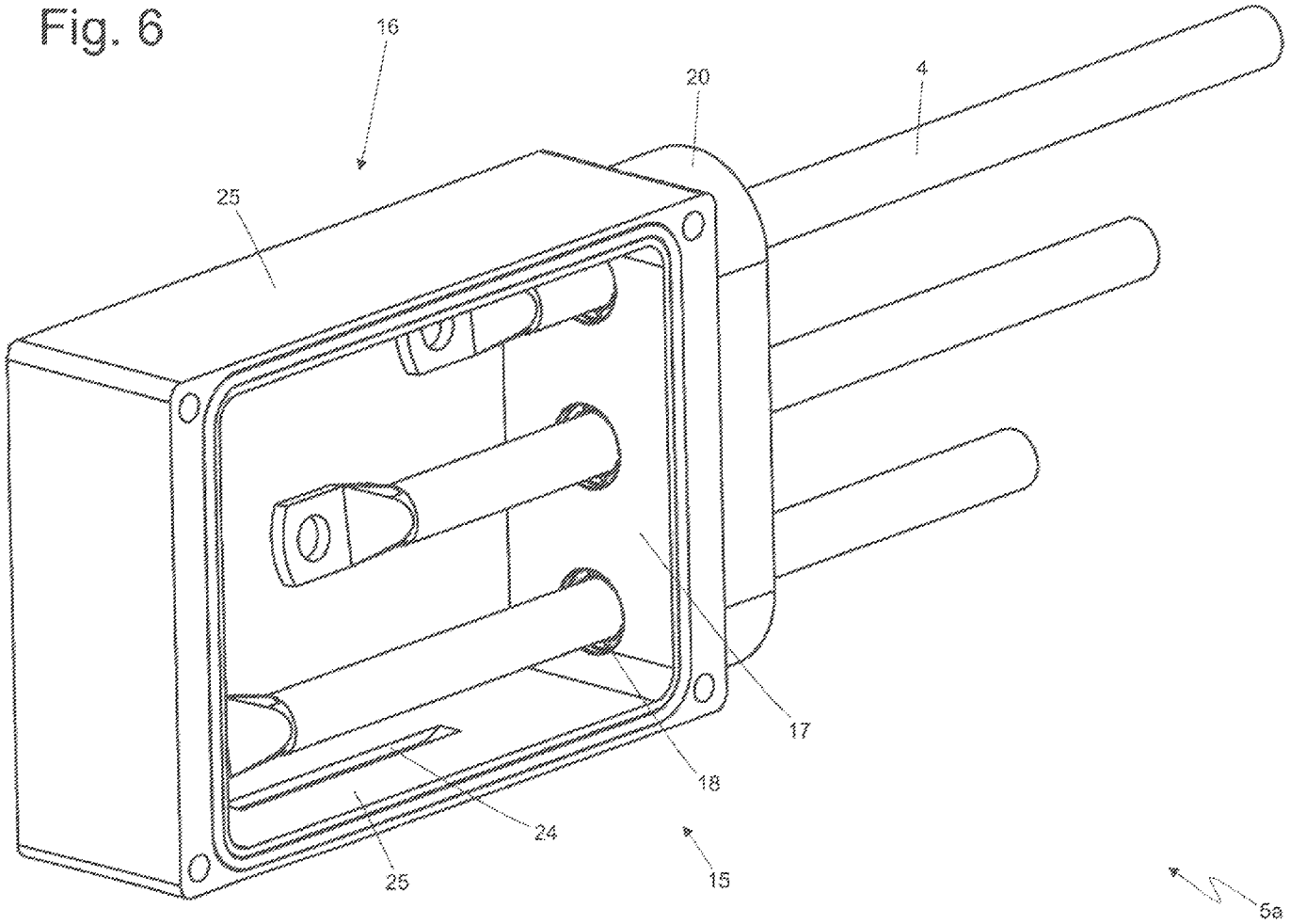
FIG. 6 is a view on an enlarged scale of a detail illustrated in FIG. 5 that shows a mobile part of the first connection system.
Figure 7:
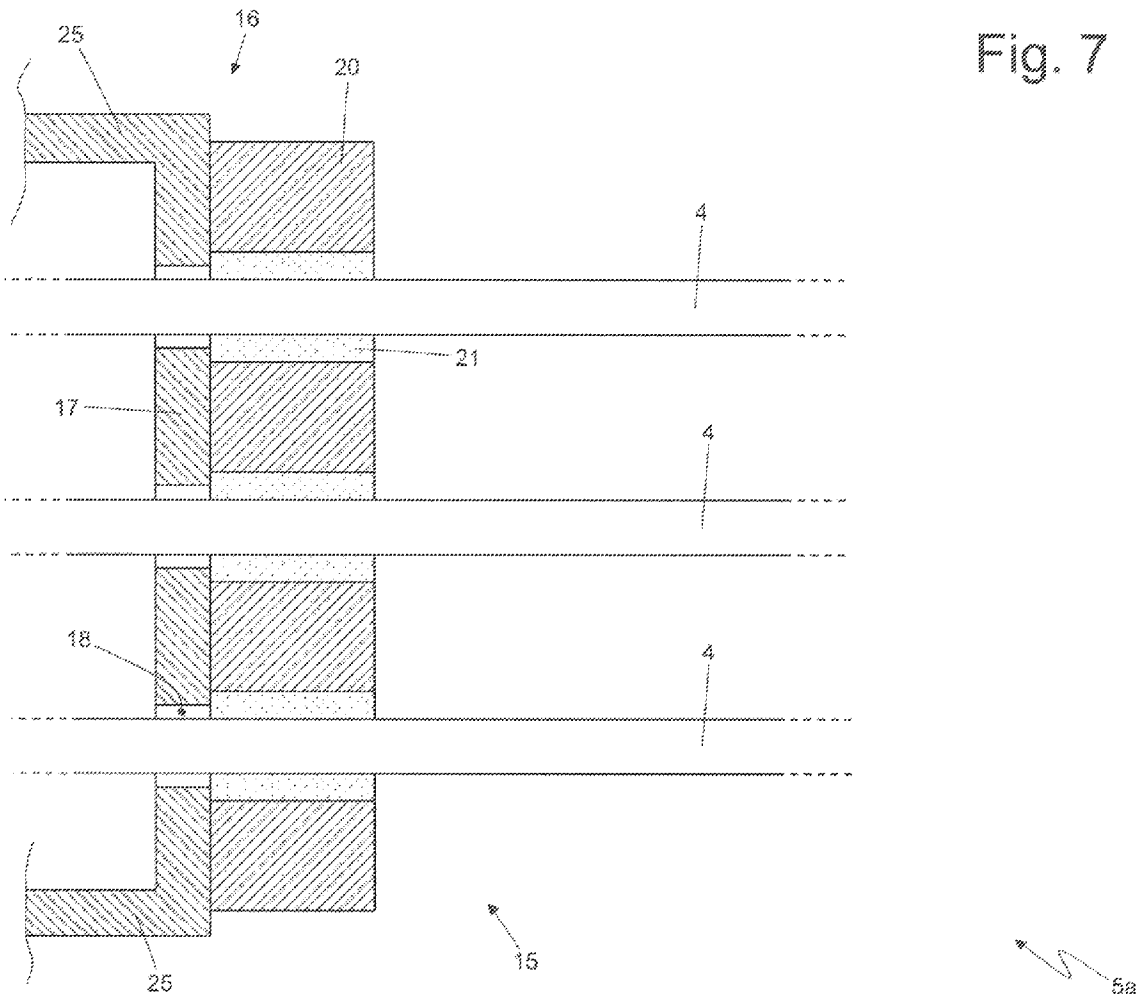
FIG. 7 is a sectional diagrammatical view of a portion of a mobile part of the first connection system.
Figure 8:
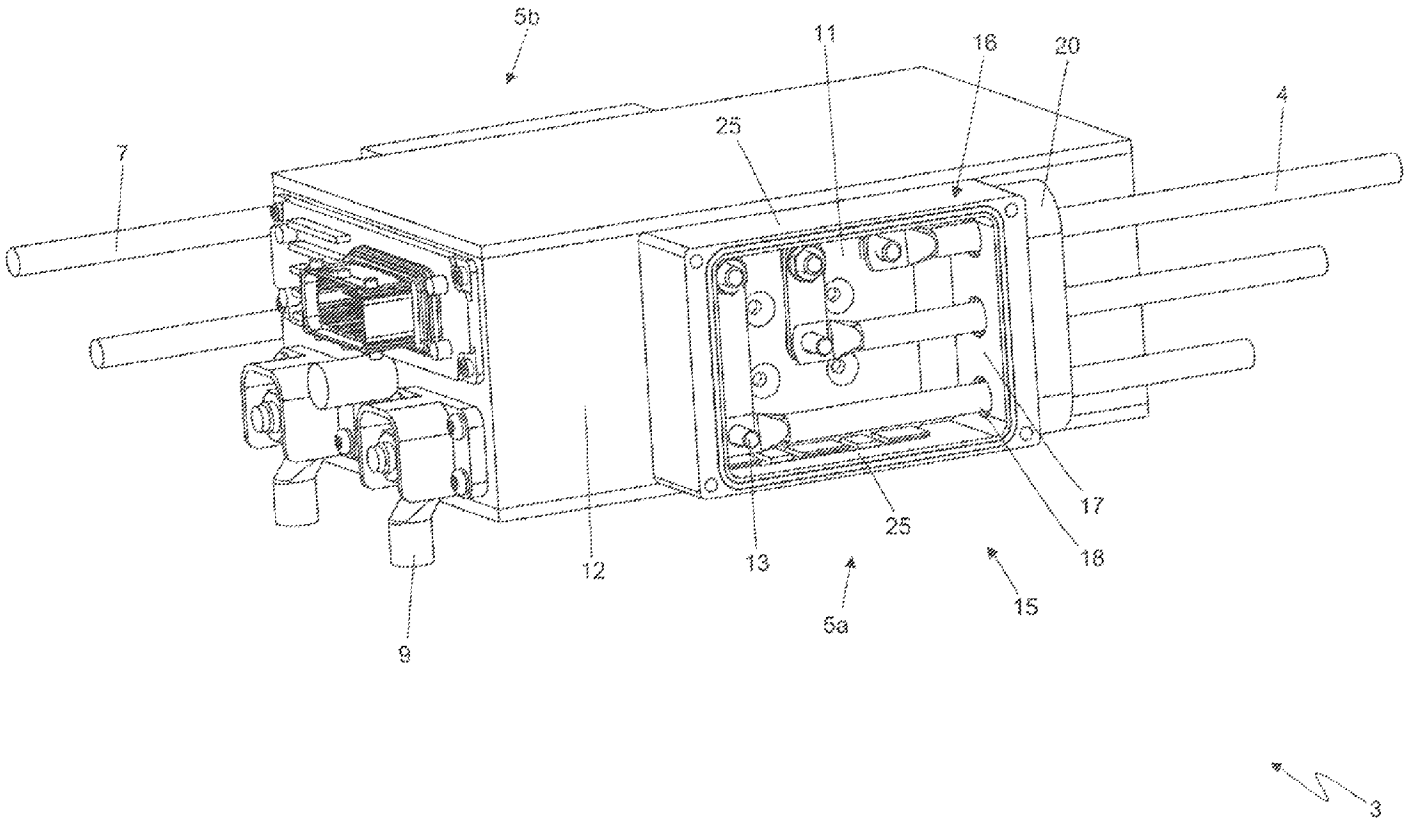
FIG. 8 is a perspective diagrammatical view of the electronic-control unit illustrated in FIG. 2 in which a mobile part of the first connection system is free from lid.

As shown in FIGS. 2-9, the connection system 5*a* further comprises a mobile part 15 provided with a perimeter frame 16 of rectangular shape that is suited to be mechanically fixed to the support base 11 of the fixed part 10. In other words, the perimeter frame 16 is shaped as a frame and internally empty (i.e., extends only along the perimeter to delimit an internal void). The perimeter frame 16 has a passage wall 17 that comprises, for each cable 4, a passage-through hole 18 through which the end of a cable 4 passes so that the corresponding cable 4 is arranged inside the perimeter frame 16 and aligned with the respective connection screw 13 of the support base 11 when the perimeter frame 16 is mechanically fixed to the support base 11 (as shown in FIG. 8). In an embodiment, the cables 4 have reciprocal differentiated lengths in the perimeter frame 16 to increase the distance between terminals.

Figure 9:
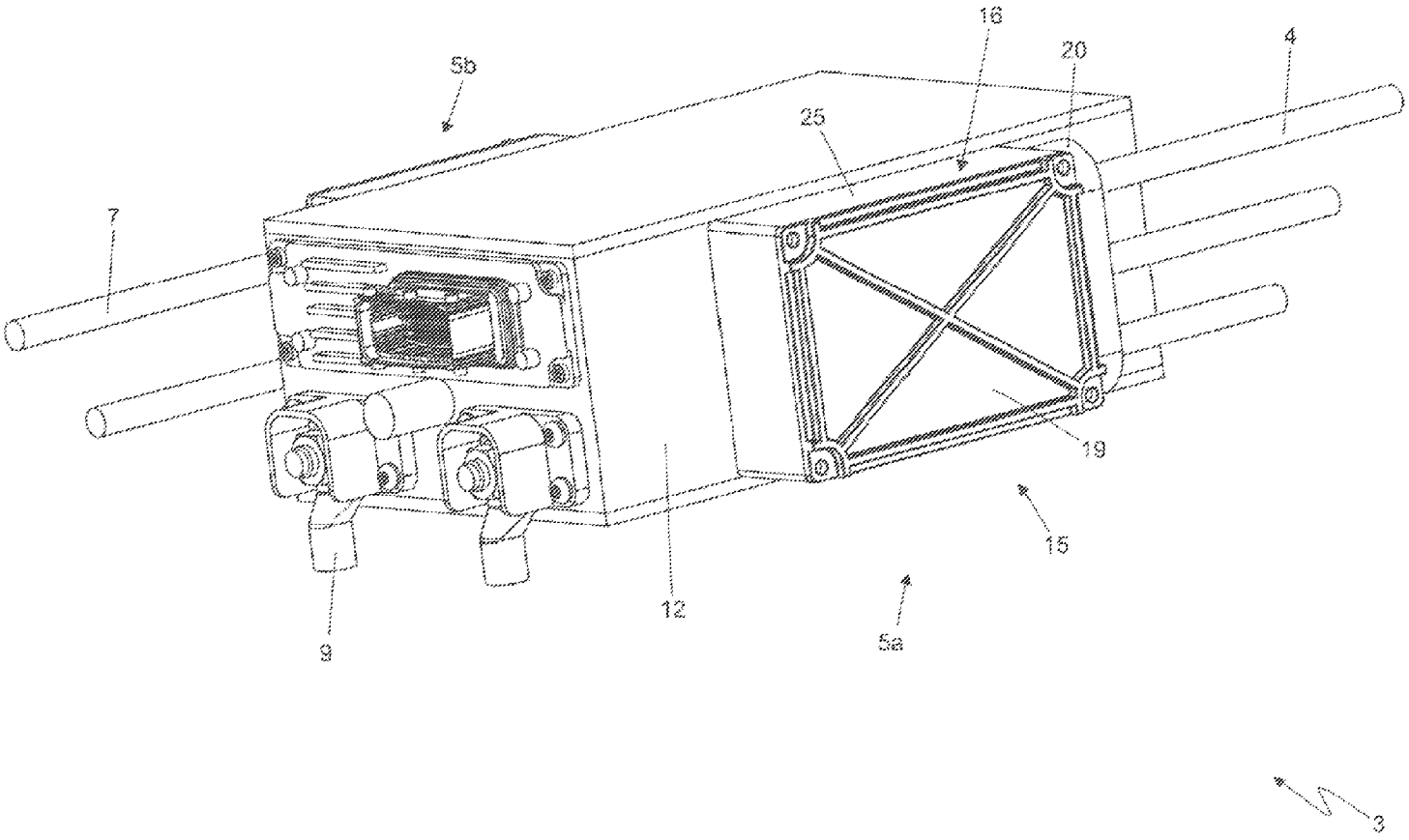
FIG. 9 is a further perspective diagrammatical view of the electronic-control unit illustrated in FIG. 2.

According to an embodiment, the mobile part 15 comprises a lid 19 that is mechanically connectable to the perimeter frame 16 by screws to externally close the perimeter frame 16 itself, forming a cup-shaped body, which cannot be accessed from the outside, when it is fitted to the support base 11 of the fixed part 10 (as shown in FIG. 9). There is inaccessibility from the outside of the terminals of the cables 4 because the connection cables 4 work at high voltage (typically 600 volts), and, thus, such live parts must be protected from accidental contacts.

As shown in FIG. 7, each cable 4 is integral with the passage wall 17 of the perimeter frame 16 to avoid relative movements between the cables 4 and perimeter frame 16. In particular, the passage wall 17 of the mobile part 15 comprises a fixing body 20 that is arranged by the side of the passage wall 17 externally to the perimeter frame 16 and integral to the passage wall 17 and establishes a mechanical connection with the cables 4 by respective cable glands 21. Each cable gland 21 is externally integral with the fixing body 20 of the passage wall 17 and internally integral with the cable 4 to make the cable 4 itself integral with the perimeter frame 16. According to an embodiment, the passage-through holes 18 obtained through the fixing body 20 are dimensioned to, have a given mechanical interference with the cable glands 21 and elastically compress the cable glands 21 themselves against the cables 4. Instead, the passage-through holes 18 of the passage wall 17 have an internal diameter (slightly) larger than the external diameter of the cables 4 so that the cables 4 do not touch the passage wall 17 (as shown in FIG. 6).

According to an embodiment, the perimeter frame 16 of the mobile part 15 is mechanically connected to the support base 11 of the fixed part 10 by a mechanical joint system. The mechanical joint system comprises joint hooks 22 (shown in FIGS. 3 and 4) carried by lateral walls 23 of the fixed part 10 that protrude from the support base 11 and display a certain capacity to be elastically deformed. Furthermore, the mechanical joint system comprises joint seats 24 that are obtained in the perimeter frame 16 (partially shown in FIGS. 5 and 6) and suited to be engaged by the joint hooks 22 when the perimeter frame 16 is coupled to the support base 11. In particular, the joint seats 24 are obtained in two lateral walls 25 of the perimeter frame 16 that are perpendicular to the passage wall 17 and arranged on opposite sides of the passage wall 17 itself.

Figure 5:
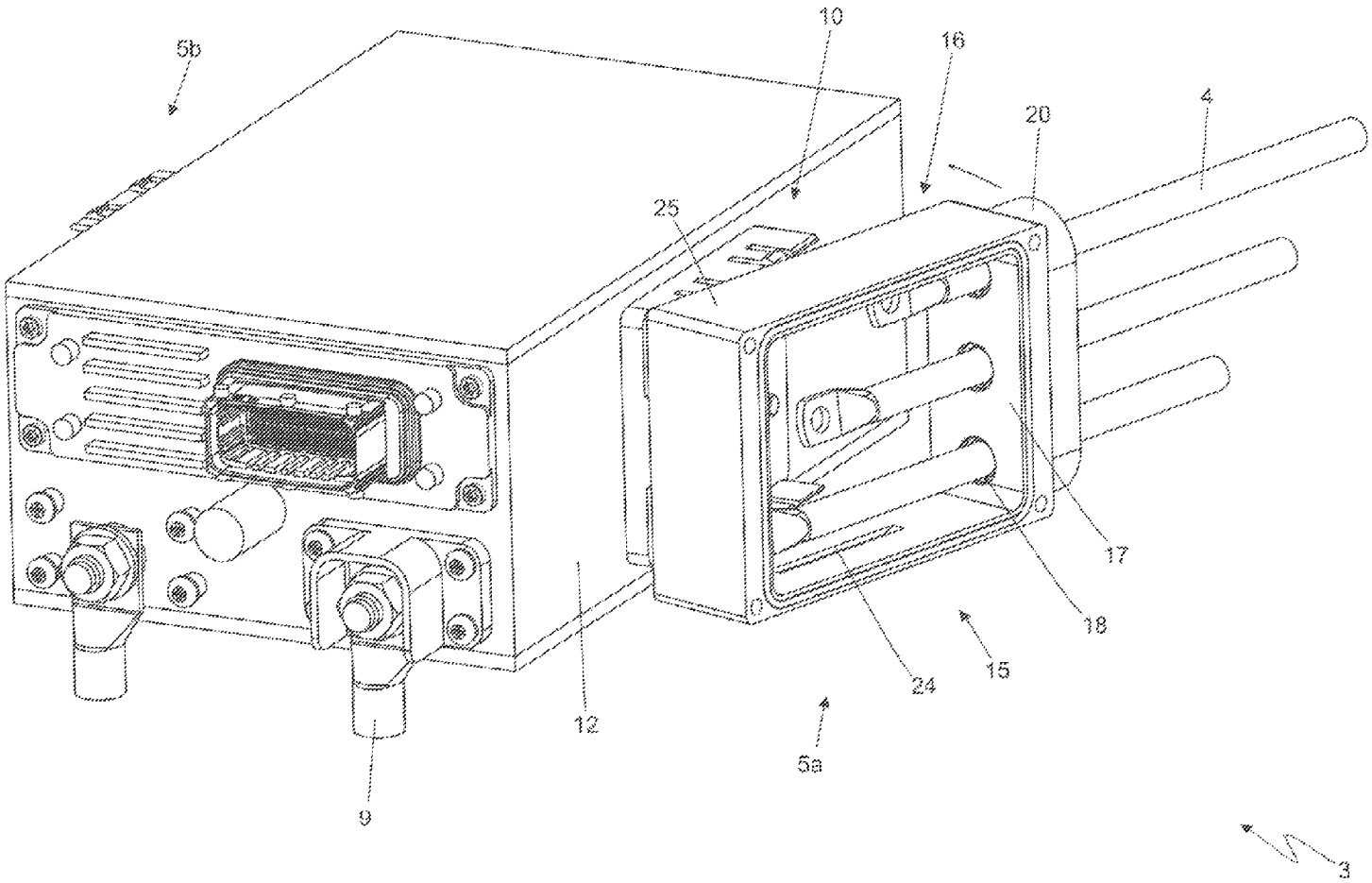
FIG. 5 is a perspective diagrammatical view of the electronic-control unit illustrated in FIG. 2 during the connection between a mobile part and fixed part of the first connection system.

The method for establishing the electrical connection between the three cables 4 and electronic-control unit by the connection system 5*a* is easily inferable from the detailed description of the connection system 5*a* above. To establish the electrical connection between the three cables 4 and electronic-control unit 3 by the connection system 5*a*, the first operation to be carried out is the mechanical connection between the perimeter frame 16 of the mobile part 11 and support base 11 of the fixed part 10, as shown in FIG. 5. This mechanical connection is extremely simple and fast because it is based on a mechanical joint that is of the "self-centering" type and may be easily also carried out without having full visibility of the support base 11 of the fixed part 10. The mechanical connection between the perimeter frame 16 of the mobile part 11 and support base 11 of the fixed part 10 also determines the "automatic" coupling of the eyelet terminals of the cables 4 with the connection screws 13 (i.e., the coupling of the perimeter frame 16 with the support base 11 also determines the fitting of the eyelet terminals of the cables 4 in the connection screws 13 without any further manual intervention by the operator). Subsequently, it is sufficient to screw the nuts 14 into the connection screws 13 to block the position of the eyelet terminal of the cables 4. Finally, the lid 19 is fitted on the perimeter frame 16 by the corresponding screws.

Figure 10:
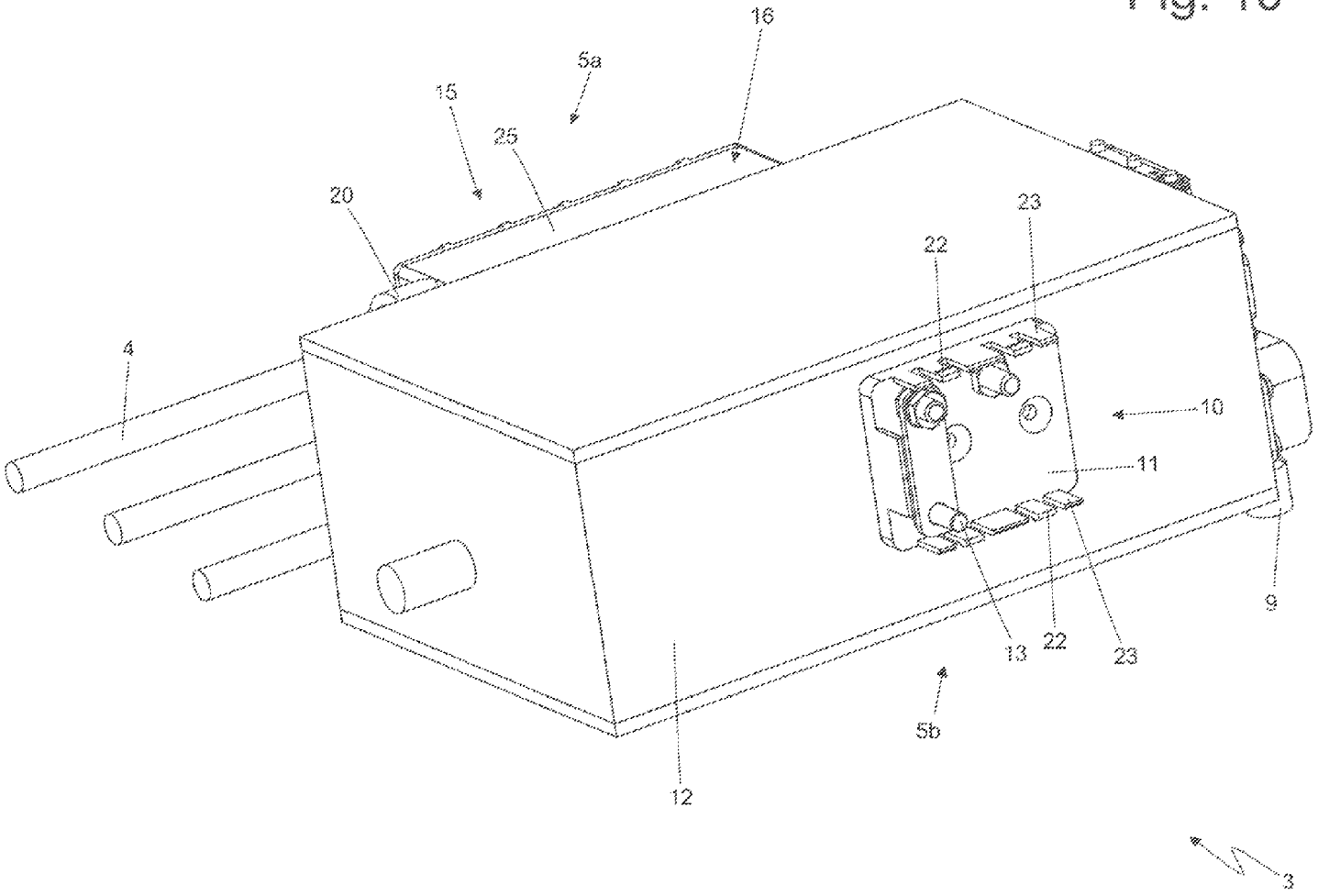
FIG. 10 is a perspective diagrammatical view of the electronic-control unit illustrated in FIG. 2 free from a mobile part of the second two-pole connection system made in accordance with the invention.
Figure 11:
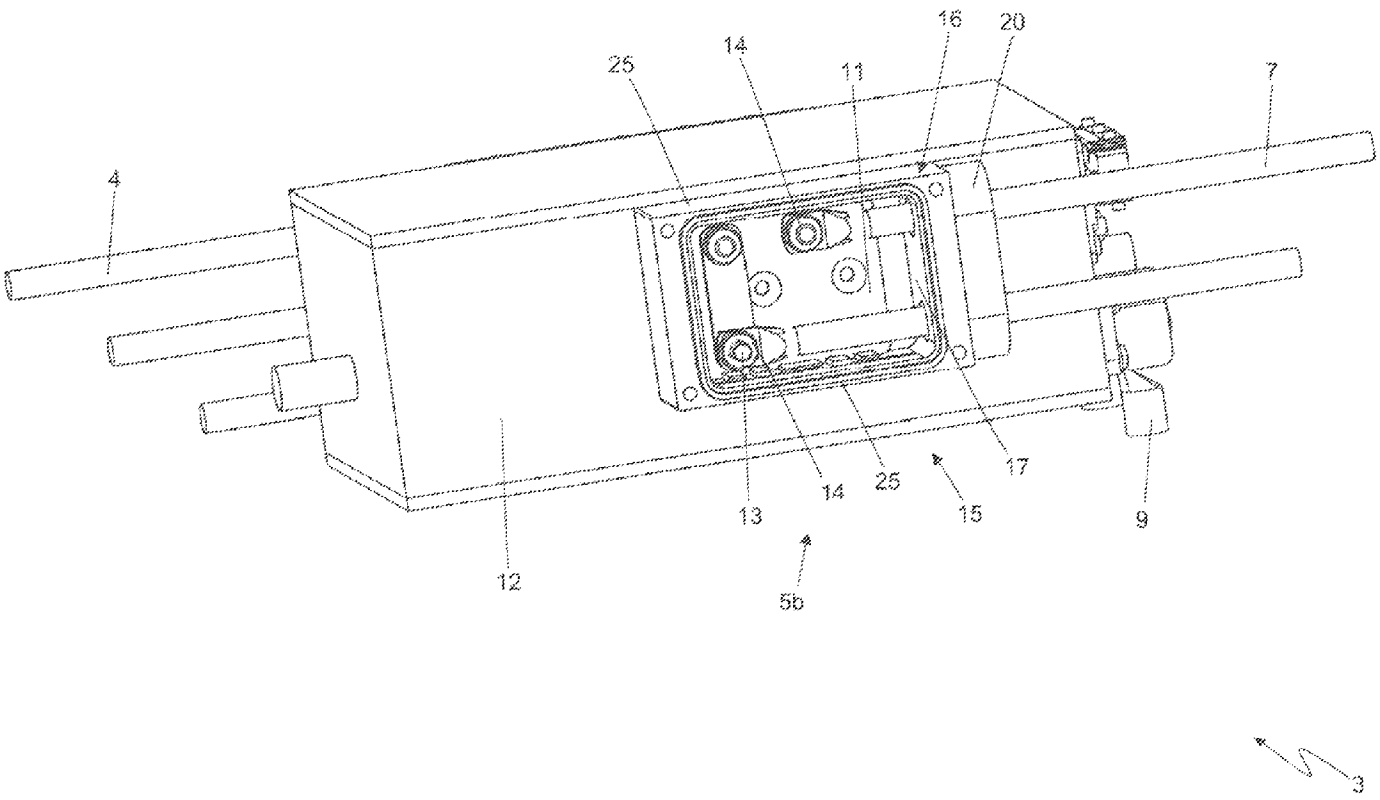
FIG. 11 is a perspective diagrammatical view of the electronic-control unit illustrated in FIG. 2 in which a-mobile part of the second connection system is free from lid.
Figure 12:
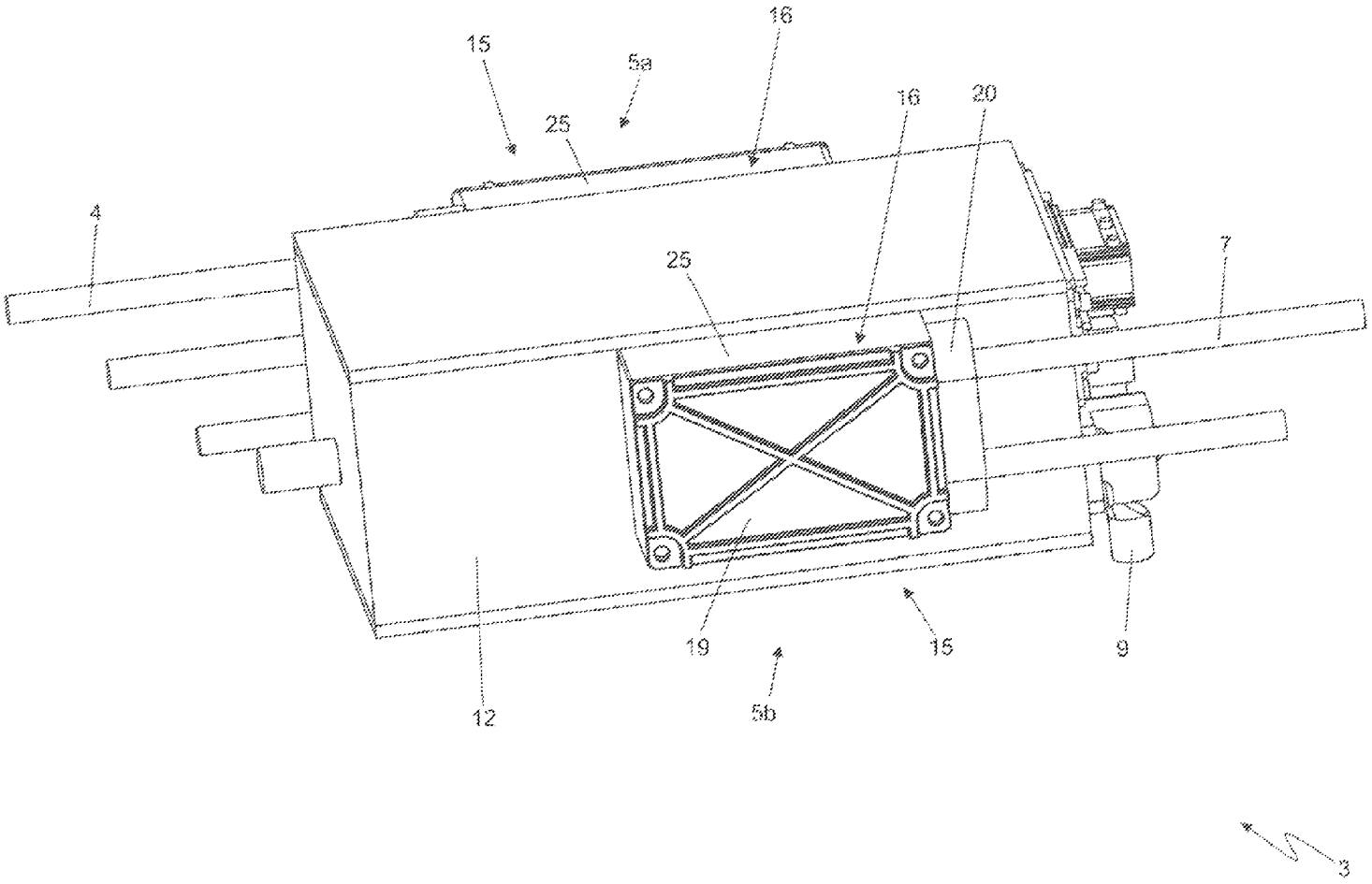
FIG. 12 is a further perspective diagrammatical view of the electronic-control unit illustrated in FIG. 2.

The connection system 5*b* shown in FIGS. 10-12 is entirely similar to the connection system 5*a* shown in FIGS. 2-9, a difference between them being that the connection system 5*a* establishes an electrical system between the electronic-control unit 3 and three cables 4 while the electronic-connection system 5*b* establishes an electrical contact between the electronic-control unit 3 and two cables 7. For a detailed description of the connection system 5*b* illustrated in FIGS. 10-12, reference is, thus, made to the detailed description of the connection system 5*a* above.

According to an embodiment, the support base 11 of the fixed part 10 is made of molded-plastic material (i.e., electrically insulating material). The lid 19 is also made of molded-plastic material (i.e., electrically insulating material). The perimeter frame 16 of the mobile part 11 is alternatively made of molded-plastic material (i.e., electrically insulating material) or metal material (i.e., electrically conducting material). When the perimeter frame 16 of the mobile part 11 is made of metal material (i.e., electrically conducting material), the perimeter frame 16 itself must be connected to the electrical ground of the electrical system 1 for reasons of safety (this connection to ground is created automatically also when the wall 12 of the electronic-control unit 3 is of metal and connected to the electrical ground).

The connection system 5 is simple and cost-effective to establish because the connection system 5 consists of a few elements of non-complex shape. Furthermore, the connection system 5 allows rapid and simple establishment/separation of an electrical connection between an electrical device for the automotive industry and at least one pair of cables. In this regard, it is not necessary to singularly or manually insert the eyelet terminals of the cables 4, 7 in the connection screws 13 because the eyelet terminals are "automatically" inserted all together in the connection screws 13 when the perimeter frame 16 of the mobile part 11 is fitted into the support base 11 on the fixed part 10. In addition, the electrical connection established by the connection system 5 is extremely reliable over time because the electrical connection cannot be accidentally interrupted in any manner (e.g., by prolonged vehicle vibrations). Moreover, the connection system 5 allows establishment of an electrical connection between any electrical device for the automotive industry (e.g., electronic-control unit, storage system, mechanical machine, etc.) and at least one pair of cables.

It should be appreciated by those having ordinary skill in the related art that the connection system 5 has been described above in an illustrative manner. It should be so appreciated also that the terminology that has been used above is intended to be in the nature of words of description rather than of limitation. It should be so appreciated also that many modifications and variations of the connection system 5 are possible in light of the above teachings. It should be so appreciated also that, within the scope of the appended claims, the connection system 5 may be practiced other than as specifically described above.

What is claimed is:

1. A connection system (5*a*, 5*b*) for establishing an electrical connection between an electrical device (3) and at least one pair of cables (4, 7) each of which ends with a cable terminal, the connection system (5*a*, 5*b*) comprising:

a fixed part (10) including a support base (11) that is adapted to be rigidly fitted to a wall (12) of the electrical device (3) and, for each of the cables (4, 7), a connection screw (13) that protrudes from the support base (11) and can be electrically connected to the-electrical device (3); and a mobile part (15) including a perimeter frame (16) that is adapted to be mechanically fitted to the support base (11) and having a passage wall (17) that comprises, for each of the cables (4, 7), a passage-through hole (18) through which an end part of the cable (4, 7) passes so that the corresponding cable terminal is disposed inside the perimeter frame (16) and aligned with the respective connection screw (13) when the perimeter frame (16) is mechanically fitted to the support base (11);

wherein the perimeter frame (16) has a rectangular shape and comprises only four walls including: the passage wall (17) provided with the passage-through holes (18), two lateral walls (25) arranged perpendicular to the passage wall (17) and on opposite sides of the passage wall (17), and an end wall arranged parallel and opposite to the passage wall (17);

wherein each of the cables (4, 7) is made integral to the passage wall (17) to avoid relative movements between the cables (4, 7) and the perimeter frame (16) before mechanically fitting the perimeter frame (16) of the mobile part (15) to the support base (11) of the fixed part (10);

wherein the mechanical connection between the perimeter frame (16) of the mobile part (11) and the support base (11) of the fixed part (10) also determines the contemporaneous coupling of the cable terminals of the cables (4; 7) to the connection screws (13); and wherein the cables (4, 7) define different lengths of the cables (4, 7) inside the perimeter frame (16) to increase distance between the cable terminals.

2. A connection system (5*a*, 5*b*) as set forth in claim 1, wherein each of the cable terminals has a shape substantially of an eyelet and is fitted substantially around the respective connection screw (13) when the perimeter frame (16) is mechanically fitted to the support base (11).

3. A connection system (5*a*, 5*b*) as set forth in claim 1, wherein the connection system (5*a*, 5*b*) comprises further, for each of the cable terminals, a nut (14) that is screwed into the respective connection screw (13) to keep the cable terminal in position.

4. A connection system (5*a*, 5*b*) as set forth in claim 1, wherein the mobile part (15) includes a lid (19) that can be mechanically connected, to the perimeter frame (16) to externally close the perimeter frame (16) forming a cup-shaped body that cannot be accessed from outside when the perimeter frame (16) is fitted to the support base (11).

5. A connection system (5*a*, 5*b*) as set forth in claim 1, wherein the perimeter frame (16) includes, for each of the cables (4, 7), a cable gland (21) that is externally integral to the passage wall (17) and internally integral to the cable (4, 7) to make the cable (4, 7) integral to the perimeter frame (16).

6. A connection system (5*a*, 5*b*) as set forth in claim 5, wherein the passage wall (17) includes a fixing body (20) that is disposed next to the passage wall (17) on an external side of the perimeter frame (16) and integral to the passage wall (17) and houses the cable glands (21).

7. A connection system (5*a*, 5*b*) as set forth in claim 6, wherein each of the passage-through holes (18) defines an internal diameter of the passage-through hole (18) that is greater than an external diameter defined by the corresponding cable (4, 7).

8. A connection system (5*a*, 5*b*) as set forth in claim 1, wherein the perimeter frame (16) is mechanically connected to the support base (11) by a mechanical joint system.

9. A connection system (5*a*, 5*b*) as set forth in claim 8, wherein the mechanical joint system includes joint hooks (22) supported by lateral walls (23) of the fixed part (10) that protrude from the support base (11) and defining a certain capacity of the joint hooks (22) to be elastically deformed and joint seats (24) that are included in the perimeter frame (16) and adapted to be engaged by the joint hooks (22) when the perimeter frame (16) is coupled to the support base (11).

10. A connection system (5*a*; 5*b*) according to claim 9, wherein the joint seats (24) are obtained in two lateral walls (25) of the perimeter frame (16), which are perpendicular to the passage wall (17) and are arranged on opposite sides of the passage wall (17).

* * * * *